United States Patent [19]

Linder

[11] Patent Number: 4,566,582

[45] Date of Patent: Jan. 28, 1986

[54] APPARATUS FOR CHANGING THE DIRECTION OF ADVANCEMENT OF A STREAM OF PAPER SHEETS OR THE LIKE

[75] Inventor: Heinz Linder, Zofingen, Switzerland

[73] Assignee: Grapha-Holding Aktiengesellschaft, Hergiswil, Switzerland

[21] Appl. No.: 545,657

[22] Filed: Oct. 26, 1983

[30] Foreign Application Priority Data

Nov. 2, 1982 [CH] Switzerland ..... 6363/82

[51] Int. Cl.[4] ..... B65H 29/60

[52] U.S. Cl. ..... 198/367; 198/442; 271/303; 271/302

[58] Field of Search ..... 271/279, 299, 303, 304, 271/305, 302, 151, 202, 216, 272, 273, 274, 314; 198/367, 442, 457, 624, 782, 372, 367

[56] References Cited

U.S. PATENT DOCUMENTS

| | | | |
|---|---|---|---|
| 4,077,519 | 3/1978 | Huber | 271/279 |
| 4,147,248 | 4/1979 | Kurczak et al. | 198/367 |
| 4,320,340 | 3/1982 | Braschos | 198/372 |

FOREIGN PATENT DOCUMENTS

| | | | |
|---|---|---|---|
| 2820957 | 12/1978 | Fed. Rep. of Germany | 271/302 |
| 2842914 | 4/1980 | Fed. Rep. of Germany | 198/372 |

*Primary Examiner*—Bruce H. Stoner, Jr.
*Assistant Examiner*—Alvin Oberley
*Attorney, Agent, or Firm*—Peter K. Kontler

[57] ABSTRACT

Apparatus for diverting selected sheets of a scalloped stream of paper sheets from a first horizontal path into a second path which is coplanar with an adjacent and parallel to the first path has two superimposed rollers movable about a vertical axis to and from operative positions above the first path, and a flap which is located upstream of the rollers and is pivotable to and from a position in which it diverts successive sheets into the nip of the rollers when the sheets enter the second path. The axes of the rollers make an oblique angle with the direction of advancement of sheets along the first path, and the speed at which the rollers are driven is such that the sheets approaching the nip cannot catch up with the sheet in the nip. The radius of curvature of the arcuate path of the rollers about the vertical axis, as well as the extent of movement of rollers along such arcuate path, is adjustable to ensure that the orientation of sheets remains unchanged during transfer from the first into the second path.

14 Claims, 5 Drawing Figures

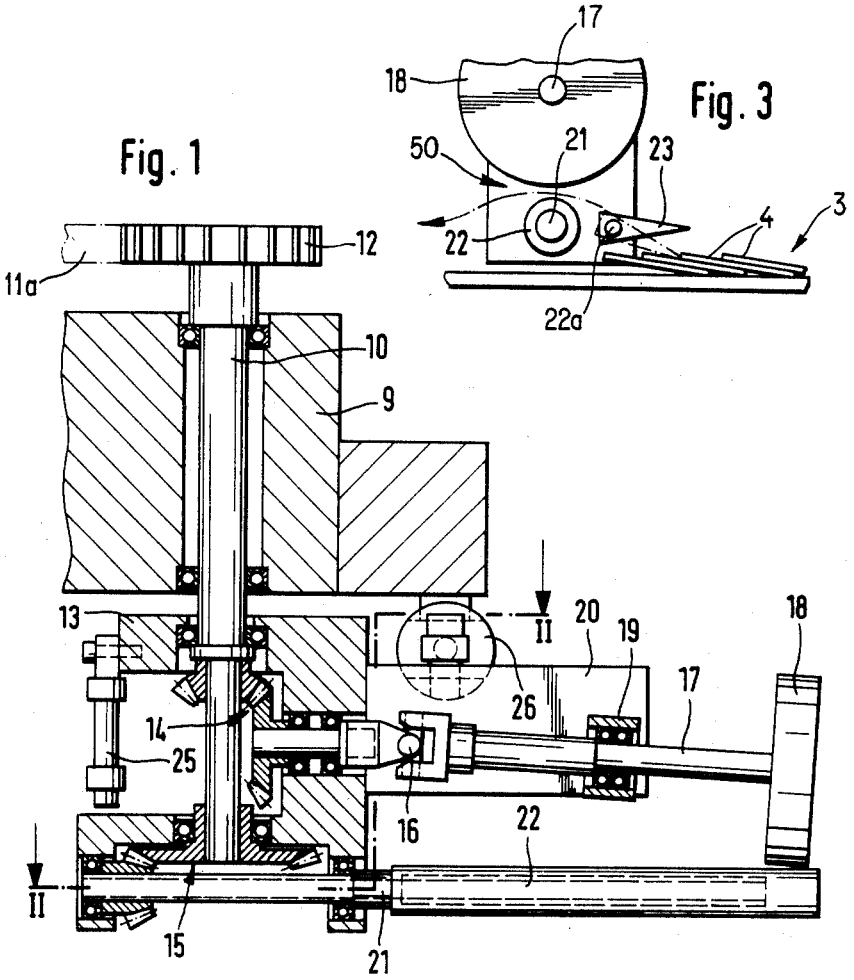
Fig. 1
11a
12
10
9
13
14
25
II
20
19
18
17
26
16
22
15
21
Fig. 3
17
18
50
21
23
22
4
3
22a
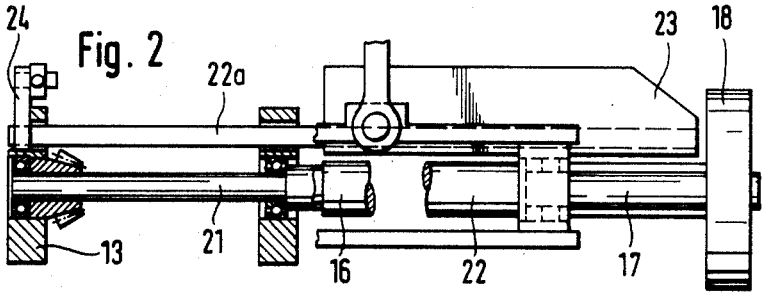
Fig. 2
24
22a
23
18
13
21
16
22
17

APPARATUS FOR CHANGING THE DIRECTION OF ADVANCEMENT OF A STREAM OF PAPER SHEETS OR THE LIKE

BACKGROUND OF THE INVENTION

The present invention relates to apparatus for manipulating flat objects and more particularly to improvements in apparatus for changing the direction of travel of a stream of flat objects, especially partly overlapping paper sheets. Such apparatus can be used to divert selected lengths of a scalloped stream of paper sheets from a first path into a different second path and vice versa.

An apparatus of the above outlined character is disclosed in commonly owned Swiss Pat. No. 617,636. It comprises two rollers which are movable between operative and inoperative positions and are disposed downstream of a deflecting member in the form of a flap which is movable between first and second positions. When the rollers assume their operative positions and the flap assumes its first position, the stream of partly overlapping objects is directed into the nip of the two rollers which advance the stream from the first into the second path. If the rollers are thereupon moved to their inoperative positions and the flap assumes its second position, the stream can pass below the flap and remains in the first path.

A drawback of the patented apparatus is that the mass of parts which must be moved between different positions is rather large. This necessitates the provision of a sturdy, bulky and stable frame as well as the provision of sturdy and bulky means for shifting the rollers and the flap between their respective positions. Another drawback of the patented apparatus is that the objects which are caused to advance from the first into and along the second path must travel from a lower level to a higher level which is not only inconvenient but plain impossible in many types of plants wherein such types of apparatus are being put to use.

OBJECTS AND SUMMARY OF THE INVENTION

An object of the invention is to provide a novel and improved apparatus which can perform the functions of the aforediscussed conventional apparatus but is of simpler and lighter construction so that the inertia of its moving parts is considerably less than the inertia of moving parts in presently known apparatus.

Another object of the invention is to provide an apparatus whose versatility exceeds that of heretofore known apparatus, especially as regards the direction or directions of travel of the diverted stream of paper sheets or other flat objects which form the stream.

A further object of the invention is to provide an apparatus which is constructed and assembled in such a way that the diverted objects can advance along a horizontal path or along a path which is inclined to the horizontal.

An additional object of the invention is to provide a novel and improved method of manipulating streams of partly overlapping flat objects, such as folded paper sheets or the like.

An ancillary object of the invention is to provide an apparatus which can be installed in existing production lines as a superior substitute for heretofore known apparatus.

The invention resides in the provision of an apparatus for diverting flat objects of a stream of such objects, particularly selected sheets of a stream of partially overlapping sheets. The apparatus comprises first conveyor means defining a first path and serving to normally advance the stream of objects along the first path in a predetermined direction, and second conveyor means defining a second path at least a portion of which is adjacent to a portion of the first path. The first and second paths are or can be essentially or exactly coplanar and are preferably adjacent and at least substantially parallel to each other. The apparatus further comprises means for diverting objects from the aforementioned portion of the first path into the aforementioned portion of the second path, and such diverting means comprises a pair of rotary elements defining a nip and being movable to and from operative positions adjacent to the aforementioned portion of the first path, a deflecting member which is located upstream of the rotary elements (as considered in the predetermined direction) and is movable between a first position remote from objects in the first path and a second position in which at least a portion of the deflecting member extends into the first path and directs the oncoming objects into the nip of the rotary elements, and means for rotating the rotary elements in directions to advance objects entering the nip into the aforementioned portion of the second path.

The paths are preferably substantially horizontal, and the deflecting member and the rotary elements are preferably disposed at a level above the first path. In accordance with a presently preferred embodiment of the invention, the rotary elements are movable to and from their operative positions along an arcuate path about an axis which is at least substantially normal to the plane of the aforementioned portion of the first path. The rotary elements are preferably movable about such axis (normally a vertical or nearly vertical axis) from the aforementioned operative positions to inoperative positions by moving in a direction away from the aforementioned portion of the first path and toward the second path. Means (e.g., one or more fluid-operated motors) can be provided to move the rotary elements about the aforementioned axis, and means (e.g., including one or more fluid-operated motors) can be provided to pivot the deflecting member between its first and second positions. The rotary elements preferably include an upper roller and a lower roller which latter is closely adjacent to the first path in the operative positions of the rotary elements. The axes of the rotary elements make with the predetermined direction an oblique angle, at least when the rotary elements assume their operative positions.

The apparatus further comprises means for driving the first conveyor means at a predetermined speed, and the rotating means is then arranged to rotate the rotary elements at a peripheral speed such that an object in the nip of the rotary elements is advanced in a second direction making with the predetermined direction the aforementioned oblique angle. The peripheral speed of the rotary elements has a component in the predetermined direction such that it at least matches the predetermined speed of the first conveyor means. This prevents the deveyopment of a pileup of objects in front of the nip.

Means (e.g., one or more feed screws) can be provided to move the aforementioned axis (about which the rotary elements turn between operative and inoperative positions) with reference to the first path (preferably sideways toward and away from the first path). The nip defines for the deflected objects a third path which connects the first and second paths, and a plane which includes the centers of gravity of objects in the nip of the rotary elements preferably makes with the predetermined direction the aforementioned oblique angle so that the orientation of objects remains unchanged during advancement from the first into the second path. The two rotary elements can be said to constitute a composite third conveyor which defines the third path extending at an oblique angle with reference to the first path and also with reference to the second path if the latter is parallel to the first path.

The means for preventing changes in orientation of the objects during transfer from the first into the second path can include means for adjustably supporting stops which limit the extent of movement of rotary elements between operative and inoperative positions and/or means for adjusting the radius of curvature of the aforementioned arcuate path for the rotary elements. To this end, the rotary elements can be mounted on shafts or arms of variable length.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a vertical sectional view of an apparatus which embodies the invention, the section being taken in the direction of arrows as seen from the line I—I in FIG. 4 or 5;

FIG. 2 is a sectional view as seen in the direction of arrows from the line II—II of FIG. 1;

FIG. 3 is an enlarged front elevational view of the two rotary elements and of the deflecting member as seen in the direction of arrow III in FIG. 4;

DESCRIPTION OF THE PREFERRED EMBODIMENTS

Figure 4:
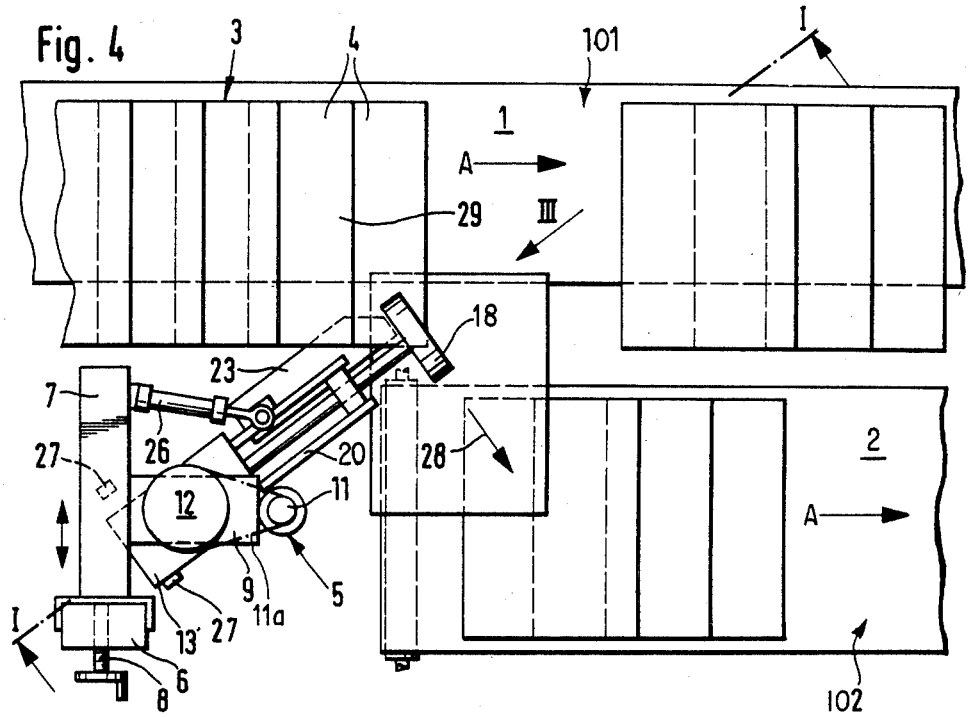
FIG. 4 is a plan view of the apparatus, with the two rotary elements shown in their operative positions.

The apparatus which is shown in FIGS. 1 to 5 serves to divert selected portions of a scalloped stream 3 of folded paper sheets 4 from a first path 1 into a second path 2 or to leave the sheets of the stream 3 in the first path. The first path 1 is coplanar with the second path 2 and is defined by one or more endless belt conveyors 101 shown in FIGS. 4 and 5, and the second path 2 is defined by one or more endless belt conveyors 102 also shown in FIGS. 4 and 5. The paths 1 and 2 are horizontal and the path 2 is parallel and coplanar with and adjacent to one side of the path 1. The conveyor 101 is driven by a motor 201 and receives successive sheets 4 of the stream 3 from a suitable folding unit which forms no part of the invention. When the need for diversion of a certain number of sheets 4 from the path 1 into the path 2 arises, the improved apparatus begins to move successive sheets 4 in the direction which is indicated by the arrow 28 (see FIG. 4) and preferably in such a way that the orientation of the transferred or deflected sheets 4 remains unchanged.

The diverting means 5 of the apparatus comprises a stationary upright carrier or support 6 for a horizontal bracket or boom 7 which extends substantially at right angles to the direction (arrows A) of advancement of sheets 4 along the path 1 or 2. One or more feed screws 8 or other suitable means are provided to move the bracket 7 in directions transversely of and toward or away from the adjacent portion of the first conveyor 101. The bracket 7 carries an arm 9 constituting a bearing for a vertical shaft 10 and a support for a motor 11. The shaft 10 is rigid with a sprocket wheel 12 receiving torque from the motor 11 through the medium of an endless chain 11*a*. The shaft 10 defines a vertical pivot axis for a gear case 13 which can turn back and forth about such axis and contains two bevel gear transmissions 14 and 15. As can be seen in FIG. 1, the transmission 14 is installed at a level above the transmission 15 and serves to rotate a shaft 17 through the medium of a universal joint 16 (e.g., a Cardanic joint). The shaft 17 is rigidly connected with a relatively large first rotary element 18 (hereinafter called wheel) which is disposed at a level above the paths 1 and 2. The shaft 17 is rotatable in one or more antifriction ball bearings 19 which are mounted in holders 20 carried by the gear case 13.

The lower bevel gear transmission 15 transmits torque to a shaft 21 which is rotatably mounted in the gear case 13 and carries an elongated rotary element 22 (hereinafter called roller) at a level below the roller 18. The diameter of the roller 22 is a small fraction of the diameter of the larger-diameter roller 18. The rollers 18 and 22 rotate in opposite directions when the motor 11 is on to drive the shaft 10 which, in turn, rotates the shafts 17 and 21 through the medium of the respective transmissions 14 and 15.

The gear case 13 further rotatably supports an additional shaft 22*a* which is parallel with and adjacent to the shaft 21 and serves to change the angular position of a deflecting member 23 in the form of a wedge-like flap. The flap 23 is located ahead of the roller 22, as considered in the direction (arrow A) of advancement of sheets 4 along the path 1 (see particularly FIGS. 4 and 5). The shaft 22*a* can move the flap 21 between a first position which is indicated in FIG. 3 by solid lines and in which the stream 3 of partly overlapping folded paper sheets 4 on the conveyor 101 can advance along the first path 1 at a level below the flap. If the flap 23 is thereupon pivoted to the phantom-line position of FIG. 3, its edge extends into the path 1 and causes successive sheets 4 to advance over the flap 23 and into the nip 50 of the rollers 18, 22 which compel such sheets to enter the second path 2. The shaft 22*a* is further rigidly connected with a lever 24 which forms part of the means for pivoting the shaft 22*a* between the two positions and whose free end portion is articulately connected with the piston rod of a fluid-operated motor here shown as a hydraulic or pneumatic cylinder and piston unit 25 whose cylinder is articulately connected with the gear case 13. The cylinder and piston unit 25 can move the flap 23 between the two positions through the medium of the lever 24 and shaft 22*a*. The level of the elongated lower roller 22 is selected in such a way that it barely provides room for advancement of successive sheets 4 therebelow (along the path 1) when the flat 23 is held in the solid-line position of FIG. 3.

The bracket 7 supports a second hydraulic or pneumatic cylinder and piston unit 26 whose cylinder is articulately connected to the bracket and whose piston rod is articulately connected with one of the holders 20 for the antifriction ball bearings or bearings 19. The cylinder and piston unit 26 serves as a means for pivoting the gear case 13 about the vertical axis of the shaft 10 to thereby move the rollers 18 and 22 between the operative positions of FIG. 4 and the inoperative positions of FIG. 5. Two (preferably adjustable) abutments or stops 27 are provided to arrest the gear case 13 in the respective positions. Adjustability of the stops 27 is desirable and advantageous because this renders it possible to select for the rollers 18, 22 any one of several operative and inoperative positions depending on the dimensions of the sheets 4 and/or other factors. It is also advisable to employ shafts 17 and 21 of variable length (for example, each of these shafts can be assembled of two or more sections which are slidably telescoped into each other). Such adjustability of the shafts 17 and 21 is desirable and advantageous because it enables the operators to change the radius of the arcuate path along which the rollers 18 and 22 move when the cylinder and piston unit 26 is actuated to turn the gear case 13 about the axis of the shaft 10.

Figure 5:
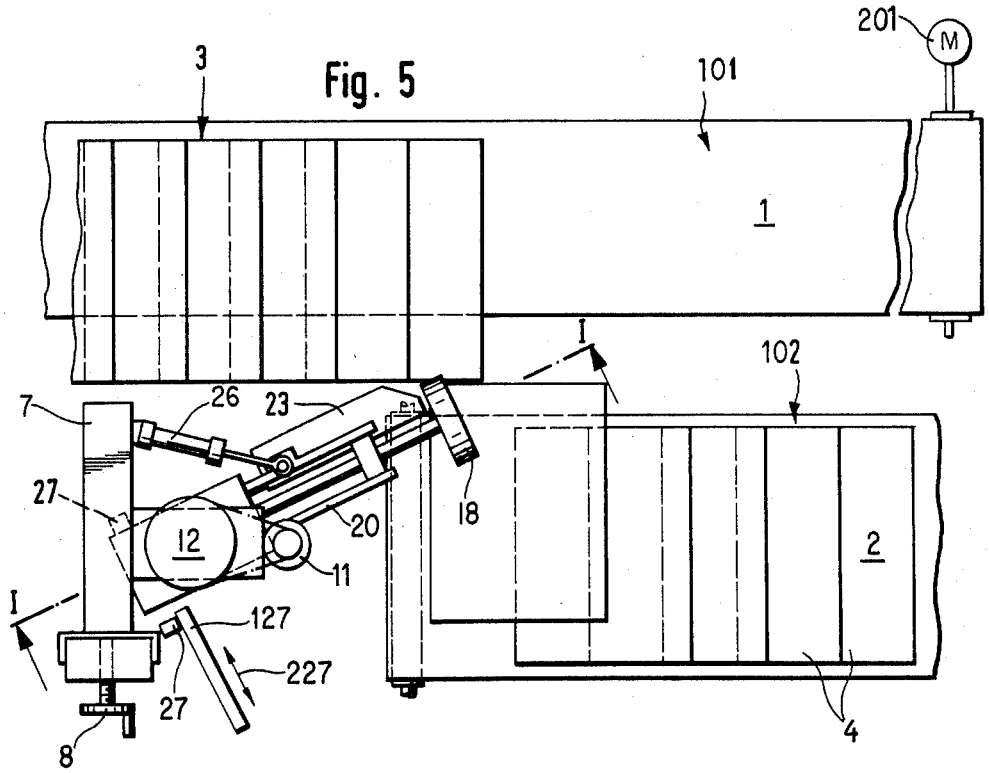
FIG. 5 is a similar plan view of the apparatus but showing the rotary elements in their inoperative positions.

FIG. 5 shows that at least one of the stops 27 is adjustable along a support 127 in directions which are indicated by a double-headed arrow 227. The other stop 27 can be adjustably mounted in the same, similar or analogous way. Adjustability of the stops 27 enables the attendants to select any one of a number of different operative positions for the rollers 18 and 22. Adjustability of the shafts 17 and 21 renders it possible to change the radius of curvature of the arcuate path along which the rollers 18 and 22 are movable between their operative and inoperative positions, and adjustability of the bracket 7 in directions transversely of the first path 1 (through the medium of the feed screw or feed screws 8 or other suitable adjusting means) enables the operators to effect additional adjustments in the positions of rollers 18, 22 with reference to the adjacent portion of the first path 1, i.e., in the positions of rollers 18, 22 with reference to the oncoming sheets 4 of the scalloped stream 3 on the conveyor 101.

The operation of the improved apparatus is as follows:

If some of the sheets 4, which form the stream 3 and advance along the first path 1 defined by the conveyor 101, are to be deflected or diverted into the second path 2, the cylinder and piston unit 26 is actuated (e.g., from a control panel, not shown) to move the gear case 13 from the angular position of FIG. 5 to that which is shown in FIG. 4. This entails a movement of the gear case 13 from abutment with one of the stops 27 into abutment with the other stop 27. The flap 23 is normally held in the solid-line position of FIG. 3 so that it is located slightly above the path 1 and does not interfere with advancement of successive sheets 4 toward and below the lower roller 22 and further on along the first path 1. This flap is moved to the phantom-line position of FIG. 3 simultaneously with or subsequent to the movement of rollers 18, 22 to the operative positions which are shown in FIG. 4 whereby the edge of the flap penetrates into the stream 3 and begins to divert the oncoming sheets 4 into the nip 50 of the rollers 18 and 22. The means for moving the flap 23 between the two positions includes the aforementioned fluid-operated motor 25 which turns the shaft **22*a* through the medium of the lever 24. The axes of the rollers 18 and 22 (in the operative positions of such rollers) are parallel to each other and extend at right angles to the direction which is indicated by the arrow 28, i.e., at right angles to the direction of advancement of successive sheets from the path 1 into the path 2. The direction which is indicated by the arrow 28 extends substantially diametrically of the sheet 4 which is engaged by the rollers 18 and 22, i.e., this direction is disposed in a plane which includes the center of gravity of the freshly engaged sheet 4. Such orientation of the rollers 18, 22 with reference to the sheets 4 on the conveyor 101 ensures that the orientation of the sheets remains unchanged during transfer from the path 1 into the path 2. In other words, the sheets 4 do not turn about a vertical axis during travel along a third path which extends from the path 1 to the path 2 but merely perform a composite movement which has a component in the direction indicated by the arrows A (this is the direction of advancement of sheets 4 along the first path 1 and second path 2) and a component which is normal to such direction. The adjustability of one or both stops 27 and/or the adjustability of the radius of curvature of the arcuate path of movement of rollers 18, 22 about the axis of the shaft 10 renders it possible to meet the just discussed requirements regardless of the dimensions of sheets 4 which form the scalloped stream 3. Thus, if the format of the sheets 4 is changed, the operator or operators adjust the positions of one or both stops 27 relative to the frame of the apparatus and/or change the effective length of the shafts 17 and 21 for the rollers 18 and 22. This ensures that the plane including the arrow 28 of FIG. 4 invariably includes the center of gravity of the sheet 4 which is in the process of being diverted from the path 1 into the path 2. Additional adjustments (for the purpose of ensuring that the plane including the arrow 28 will include the center of gravity of a small, medium-sized or large sheet which is in the process of being transferred from the path 1 into the path 2) can be effected by means of the feed screw or feed screws 8 which can change the position of the bracket 7 for the arm 9 (which carries the gear case 13 and hence the shafts 17, 21 and 22*a*) with reference to the conveyor 101, namely, the distance between the bracket 7 and the first path 1**.

The apparatus continues to divert successive sheets 4 into the second path 2 as long as the rollers 18, 22 are held in the operative positions of FIG. 4 and as long as the flap 23 is held in the phantom-line position of FIG. 3. In order to terminate such diversion of sheets 4 from the first path 1, the operator or operators cause the cylinder and piston unit 26 to return the flap 23 to the solid-line position of FIG. 3, and the cylinder and piston unit 25 is also actuated to return the gear case 13 into abutment with the upper stop 27 of FIG. 5. This moves the rollers 18 and 22 sufficiently away from the path 1 to ensure that such rollers cannot interfere with advancement of successive sheets 4 along the conveyor 101 and on to a gathering or other consuming or processing machine, not shown. When the last deflected sheet 4 has been transferred into the path 2, the cylinder and piston unit 26 is preferably actuated again to return the gear case 13 to the angular position of FIG. 4 so that the diverting means 5 is ready for use as soon as the flap 23 is again caused to assume the phantom-line position of FIG. 3. In other words, the mounting of rollers 18 and 22 is such that they do not interfere with the advancement of sheets 4 along the first path 1 irrespective of the angular position of the gear case 13 as long as the flap 23 remains in the solid-line position of FIG. 3.

The peripheral speed of the rollers 18 and 22 is selected in such a way that the component of movement of a sheet 4 in the nip 50 of these rollers in the direction which is indicated by the arrows A (namely, in the direction of advancement of sheets 4 along the first path 1 and along the second path 2) at least equals the speed of the conveyor 101. This ensures that the distance between the sheet 4 which is in the process of being transferred from the path 1 into the path 2 and the next-following sheet 4 (as considered in the direction indicated by the upper arrow A of FIG. 4) is not reduced when the diverting means 5 is in actual use. Any reduction of the speed of a sheet which is in the process of being diverted into the path 2 could result in a pileup of sheets at the location of the flap 3 and/or in the nip 50 of the rollers 18, 22.

The weight and inertia of the diverting means 5 can be reduced well below the weight and inertia of conventional diverting means because the paths 1 and 2 are preferably closely adjacent to and parallel with one another. The apparatus can divert sheets 4 from the portion 29 (FIG. 4) of the first path 1 into a second path which is coplanar with the first path as well as into a second path which is inclined with reference to the first path (e.g., which slopes downwardly from a horizontal or substantially horizontal first path). The speed of the conveyor 101 and the peripheral speed of the rollers 18, 22 can be such that the sheets which travel along the third path (arrow 28 in FIG. 8) are deposited or propelled onto the adjacent portion of the conveyor 102.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for diverting flat objects of a stream of such objects, particularly selected sheets of a stream of partially overlapping sheets, comprising first conveyor means defining a substantially horizontal first path and arranged to normally advance the stream along such first path in a predetermined direction; second conveyor means defining a substantially horizontal second path having a portion adjacent to a portion of said first path, said first and second paths being essentially coplanar and being adjacent and substantially parallel to each other; and means for diverting objects from said portion of said first path into said portion of said second path, including a pair of rotary elements disposed at a level above said first path, defining a nip and being movable to and from operative positions adjacent to said portion of said first path about an axis which is substantially normal to the plane of said portion of said first path, a deflecting member disposed at a level above said first path and upstream of said rotary elements, as considered in said direction, and movable between a first position remote from the objects in said first path and a second position in which said deflecting member extends into said first path and directs the oncoming objects into said nip, and means for rotating said rotary elements in directions to advance the objects entering said nip into said portion of said second path.

2. The apparatus of claim 1, wherein said rotary elements are movable about said axis from said operative positions to inoperative positions in a direction away from said portion of said first path and toward said second path.

3. The apparatus of claim 1, further comprising means for moving said rotary elements about said axis.

4. The apparatus of claim 1, further comprising means for pivoting said deflecting member between said first and second positions.

5. The apparatus of claim 1, wherein said rotary elements include an upper roller and a lower roller and said lower roller is closely adjacent to said first path in the operative positions of said rotary elements.

6. The apparatus of claim 1, wherein the axes of said rotary elements make with said predetermined direction an oblique angle in the operative positions of said rotary elements.

7. The apparatus of claim 6, further comprising means for driving said first conveyor means at a predetermined speed, said rotating means being arranged to rotate said rotary elements at a peripheral speed such that an object in said nip is advanced in a second direction making said oblique angle with said predetermined direction, said peripheral speed having a component at least matching said predetermined speed in said predetermined direction.

8. Apparatus for diverting flat objects of a stream of such objects, particularly selected sheets of a stream of partially overlapping sheets, comprising first conveyor means defining a first path and arranged to normally advance the stream along such first path in a predetermined direction; second conveyor means defining a second path having a portion adjacent to a portion of said first path, said first and second paths being essentially coplanar and being adjacent and substantially parallel to each other; means for diverting objects from said portion of said first path into said portion of said second path, including a pair of rotary elements defining a nip and being movable to and from operative positions adjacent to said portion of said first path, a deflecting member located upstream of said rotary elements, as considered in said direction, and movable between a first position remote from the objects in said first path and a second position in which said deflecting member extends into said first path and directs the oncoming objects into said nip, and means for rotating said rotary elements in directions to advance the objects entering said nip into said portion of said second path, said rotary elements being movable to and from said operative positions about an axis which is at least substantially normal to the planes of said paths; and means for moving said axis with reference to said first path.

9. The apparatus of claim 8, wherein the axes of said rotary elements make with said predetermined direction an oblique angle so that said nip defines for deflected objects a third path connecting said first and second paths, a plane which includes the centers of gravity of objects in said nip making with said predetermined direction said oblique angle so that the orientation of objects remains unchanged during advancement from said first into said second path along said third path.

10. The apparatus of claim 1, further comprising means for preventing changes in the orientation of objects during transfer from said first into said second path.

11. Apparatus for diverting flat objects of a stream of such objects, particularly selected sheets of a stream of partially overlapping sheets, comprising first conveyor means defining a first path and arranged to normally advance the stream along such first path in a predetermined direction; second conveyor means defining a second path having a portion adjacent to a portion of said first path, said first and second paths being essentially coplanar and being adjacent and substantially parallel to each other; means for diverting objects from said portion of said first path into said portion of said second path, including a pair of rotary elements defining a nip and being movable to and from operative positions adjacent to said portion of said first path, a deflecting member located upstream of said rotary elements, as considered in said direction, and movable between a first position remote from the objects in said first path and a second position in which said deflecting member extends into said first path and directs the oncoming objects into said nip, and means for rotating said rotary elements in directions to advance the objects entering said nip into said portion of said second path; means for moving said rotary elements along an arcuate path from said operative positions to inoperative positions about an axis which is substantially normal to the planes of said paths; stop means for limiting the extent of movement of said rotary elements about said axis; and means for preventing changes in the orientation of objects during transfer from said first into said second path.

12. The apparatus of claim 11, wherein said preventing means comprises means for adjustably supporting said stop means so as to allow for changes in the extent of movement of said rotary elements about said axis.

13. The apparatus of claim 11, wherein said preventing means includes means for effecting a change in the radius of curvature of said arcuate path.

14. The apparatus of claim 13, wherein said means for effecting a change in said radius of curvature comprises variable-length shafts for said rotary elements.

* * * * *